United States Patent [19]

Fukuoka et al.

[11] 4,450,933

[45] May 29, 1984

[54] SUCTION SILENCER

[75] Inventors: Takashi Fukuoka, Fuchu; Yoshiaki Nagao; Hiroyuki Tanaka, both of Tokyo, all of Japan

[73] Assignee: Kioritz Corporation, Tokyo, Japan

[21] Appl. No.: 423,365

[22] Filed: Sep. 24, 1982

[51] Int. Cl.[3] ..... F02M 35/12

[52] U.S. Cl. ..... 181/229; 181/240; 181/256; 181/281; 30/381

[58] Field of Search ..... 181/229, 230, 240, 264, 181/256, 281; 55/276, DIG. 28, DIG. 31; 123/41.62; 30/381

[56] References Cited

U.S. PATENT DOCUMENTS

| | | | |
|---|---|---|---|
| 2,764,142 | 9/1956 | McMullen | 181/229 X |
| 2,942,683 | 6/1960 | Moyer | 181/229 |
| 3,120,876 | 2/1964 | Lirette | 181/229 |
| 3,800,910 | 4/1974 | Rose | 181/229 |
| 3,855,976 | 12/1974 | Notaras et al. | 123/41.62 |

FOREIGN PATENT DOCUMENTS 47214 11/1980 Japan .

*Primary Examiner*—Benjamin R. Fuller

*Attorney, Agent, or Firm*—Karl W. Flocks; Sheridan Neimark

[57] ABSTRACT

A suction silencer for suppressing generation of noise caused by gas or air sucked by a machine such as a compressor, internal combustion engine or the like. The suction silencer has amounting seat by which it is mounted on the suction side of a machine such as an internal combustion engine. The mounting seat has an opening leading to the suction port of the machine. An inversed conical surface protrudes from the peripheral edge of the opening. A lid member is attached to cover the inversed conical surface such that a small gap is left between the inner surface of the lid member and the large-diameter end of the inversed conical surface. The lid member has an inversed conical member which projects into the space defined by the conical surface so that an annular passage is formed between the inversed conical surface and the peripheral surface of the inversed conical member.

3 Claims, 5 Drawing Figures

SUCTION SILENCER

BACKGROUND OF THE INVENTION

The present invention relates to a suction silencer for use in machines such as air compressors, internal combustion engines or the like.

Machines which suck gas or air, such as air compressors, internal combustion engines and so forth employ a suction silencer for suppressing the generation of noise by the sucked gas or air. It is well known that a silencing effect is achieveable by making the gas or air expand and contract repeatedly.

BRIEF SUMMARY OF THE INVENTION

The invention aims as its principal object at providing a suction silencer which relies upon the principle explained above.

More specifically, it is a primary object of the invention to provide a suction silencer in which the sucked gas or air is made to pass through an annular passage defined by two conical surfaces thereby to reduce the level of the noise.

Another object of the invention is to provide a suction silencer which, when mounted on the intake opening of a carburetor of an internal combustion engine, effectively serves also as a plate for preventing so-called blowing back of air-fuel mixture.

To this end, according to the invention, there is provided a suction silencer comprising a mounting seat at which the suction silencer is mounted on the suction side of a machine adapted to suck gas or air, the mounting seat having therein an opening communicating with the suction port of the machine; a member defining an inversed conical surface continuous with the peripheral edge of the opening; and a lid member covering the larger-diameter end of the inversed conical surface with a predetermined gap left therebetween, the lid member having an inversed conical member projcting into the space defined by the inversed conical surface.

Preferably, the member defining the inversed conical surface is surrounded by a region which constitutes a filter for filtrating the gas or air to be sucked through the suction silencer.

There and other objects, features and advantages of the invention will become clear from the following description of the preferred embodiment taken in conjunction with the accompanying drawings.

DESCRIPTION OF THE PREFERRED EMBODIMENT

Figure 1:
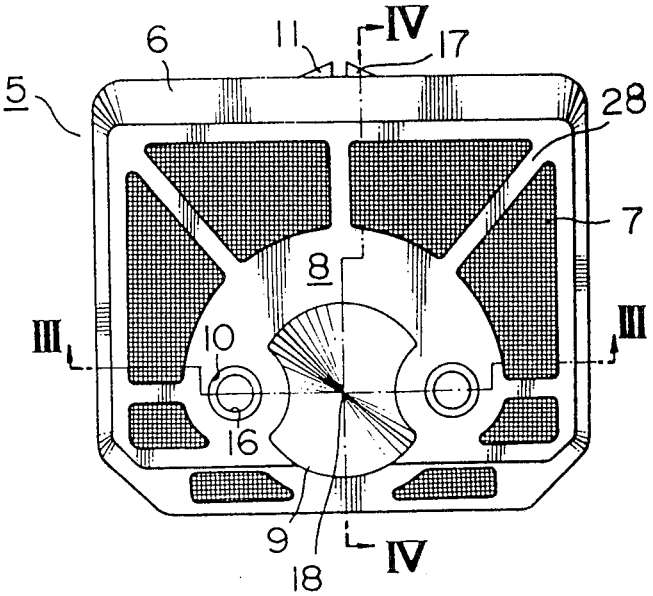
FIG. 1 is a plan view of a suction silencer in accordance with an embodiment of the invention.
Figure 2:
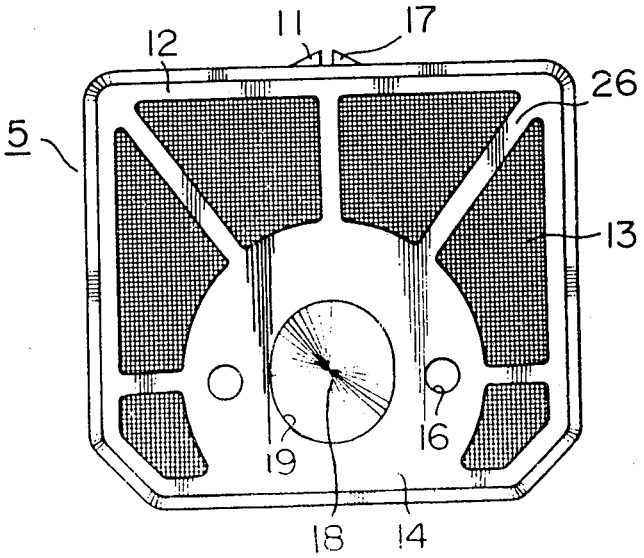
FIG. 2 is a bottom plan view of the suction silencer shown in FIG. 1.
Figure 3:
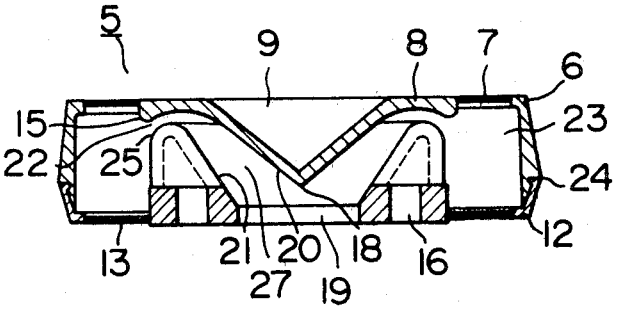
FIG. 3 is a sectional view taken along the line III—III of FIG. 1.
Figure 4:
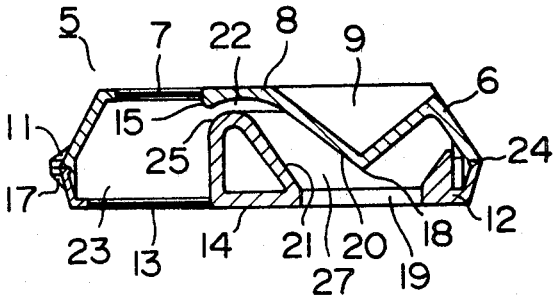
FIG. 4 is a sectional view taken along the line IV—IV of FIG. 1.

The invention will be fully described hereinunder with reference to the accompanying drawings.

The attached drawings in combination show a suction silencer in accordance with a first embodiment of the invention which is suitable for use in combination with a carburetor 3 for the engine of a portable machine such as chain saw 1. The suction silencer of the invention, generally designated at a reference numeral 5, is assembled as a unit with an air filter and this unit is attached through an elbow 4 to the intake opening of the carburetor 3 which is accomodated by a carburetor chamber 2 provided in the machine 1. The suction silencer 5 has a box-like body of a substantially square shape, composed of an upper housing part and a lower housing part 6 and 12 coupled to each other to define therein a cavity 23. A substantially circular lid plate 8 is provided on the upper surface of the upper housing part 6. The like plate 8 is connected to the peripheral portion of the upper housing part 6 through ribs 28. Each region defined by adjacent ribs 28 is covered by a gauze wire 7 of fine mesh constituting a filter which permits the internal cavity 23 to communicate with the exterior. Preferably, the gauze wire 7 is formed as a unit with the upper housing part 6. The lid plate 8 is recessed at its central portion as at 9 so that the central portion of the lid plate 8 as a whole presents an inversed conical body 20 whose apex 18 is directed towards the internal cavity 23. Mounting screw holes 10 formed in the base portion of the conical body 20 are adapted to receive screws by means of which the lid plate 8 is mounted on the body of the machine 1. A substantially circular mounting seat 14 is provided on the lower surface of the lower housing part 12 at a portion of the latter corresponding to the aforementioned lid plate 8. As in the case of the upper housing part 6, the mounting seat 14 is connected to the peripheral portion through ribs 26. Each region defined by adjacent ribs 26 is covered with a gauze wire 13 of fine mesh which consitutes a filter through which the internal cavity 23 is communicated with the exterior. The mounting seat 14 is provided with an opening 19 whose center substantially aligns with the apex 18 of the inversed conical body 20. The internal cavity 23 is communicated with the suction port of the carburetor 3 through the opening 19. An inversed frusto-conical surface 21 is protruded from the peripheral edge of the opening 19 towards the internal cavity 23. The peripheral edge 25 of the large-diameter end of the frusto-conical surface 21 is rounded and positioned to oppose to the inner surface of the lid plate 8 with a small gap 22 left therebetween. Holes 16 are formed in the portions of the mounting seat 14 corresponding to the mounting screw holes 10 of the upper housing part 6.

In order to obtain an airtight seal in the juncture 24 between the upper housing part 6 and the lower housing part 12, a ridge is formed on the juncture surface of one of these housing parts while a mating grove is formed in the mating surface of the other. Reference numerals 11 and 17 denote tool engaging portions into which a screw driver or the like tool is inserted to forcibly separate the upper and lower housing parts 6 and 12.

By assembling these two housing parts 6 and 12 together, the inversed conical body 20 is projected into the space 27 defined by the frusto-conical portion 21 so that a substantially annular passage is formed between two conical surfaces.

Figure 5:
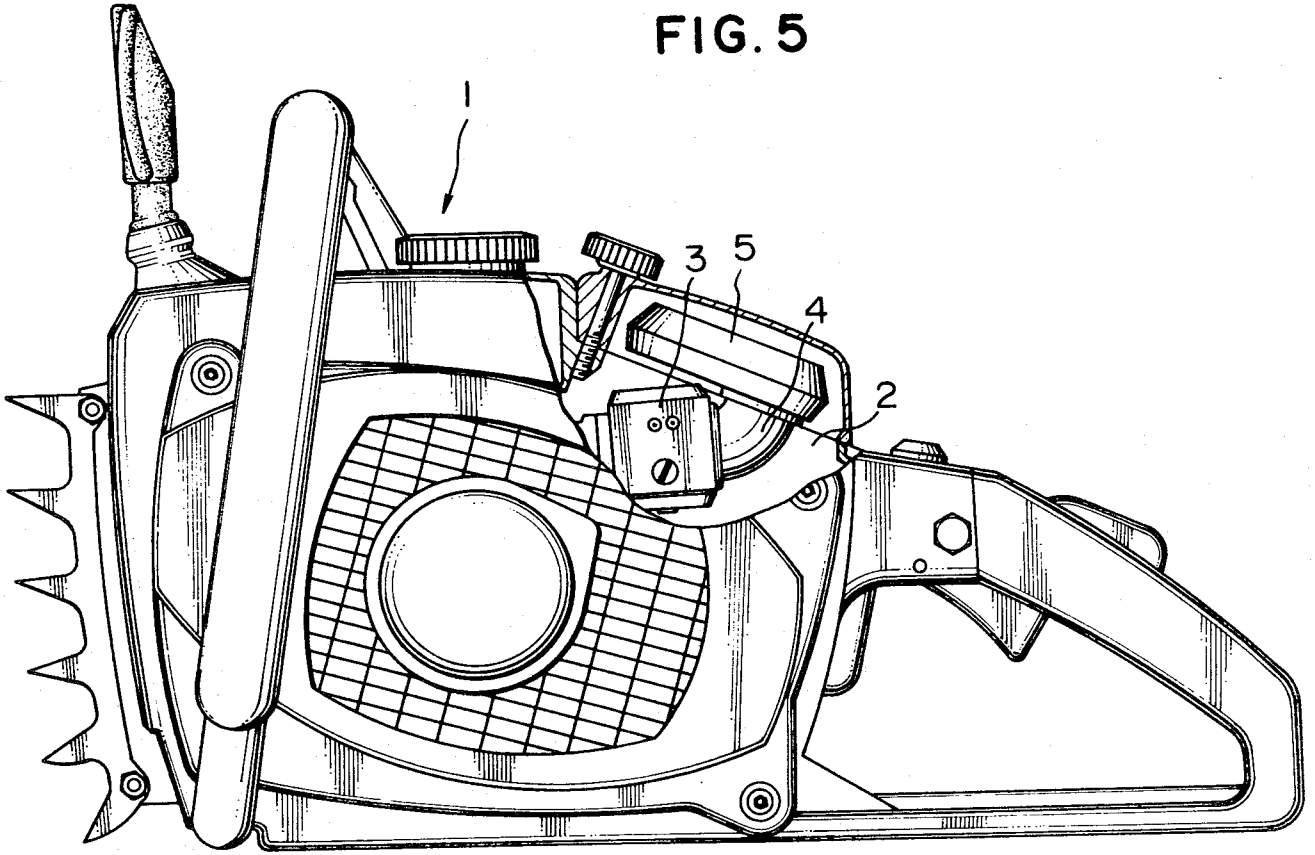
FIG. 5 is an illustration of the suction silencer in the state of use.

As shown in FIG. 5, the suction silencer 5 of the invention having the described construction is attached through the elbow 4 to the carburetor 3. As the engine is started, the ambient air is sucked through the upper and lower filter gauze wires 7, 13 and the filtrated air is introduced into the internal cavity 23 which has a considerably large volumn. The air then flows through the annular gap 22 while being guided by the inner surface of the lid plate 8 (preferably provided with a guide protrusion 15) and rounded peripheral edge 25 so as to be deflected substantially by 180°. The air is then made to flow through the annular passage between two conical surfaces and sucked ito the carburetor 3 through the opening 19. In consequence, the air is first introduced into the internal cavity 23 of a comparatively large volume and then guided through the restricted annular gap 22 where the air is subjected to an abrupt contraction and turning of flowing direction. Thereafter, the flow of air is settled as it passes the annular passage and is then introduced to the opening 19 which has a comparatively large cross-sectional area. In consequence, the noise produced by the sucked air is suppressed effectively by the repetitional expansion and contraction.

Assuming here that there is a blowing back of air-fuel mixture from the carburetor 3, the droplets of fuel are returned to the carburetor 3 without fail while being guided by the conical surface. In consequence, various problems attributable to the blowing back of air-fuel mixture, e.g. contamination or clogging of the filter gauze wires 7 and 13, are avoided advantageously.

A series of tests was conducted to confirm the effect of the suction silencer of the invention, by employing an air-cooled 2-cycle engine having a displacement of 66 cc, for various combinations of the size of the annular gap 22 and the shape of the annular passage defined between two conical surfaces. The best combination provided about 5 db reduction in the noise level while suppressing the reduction of output power of the engine to a low level of about 3%.

Although the invention has been described through specific terms, it is to be noted here that the described embodiment is not exclusive and various changes and modifications may be imparted thereto wihtout departing from the scope of the invention which is limited solely by the attached claims.

What is claimed is:

1. A suction silencer comprising a mounting seat at which said suction silencer is mounted on the suction side of a machine adapted to suck gas or air, said mounting seat having therein an opening communicating with the suction port of said machine; a member defining an inversed conical surface continuous with the peripheral edge of said opening; and a lid member covering the large-diameter end of said inversed conical surface with a predetermined gap left therebetween, said lid member having an inversed conical member projecting into the space defined by said inversed conical surface.

2. A suction silencer according to claim 1, wherein said member defining said inversed conical surface is surrounded by a region which constitutes a filter for filtrating gas or air to be sucked through said suction silencer.

3. A suction silencer according to claim 1, wherein said opening in said mounting seat leads to the intake port of a carburetor mounted on an internal combustion engine.

* * * * *